US005172987A

United States Patent [19]

Stellmach et al.

[11] Patent Number: 5,172,987

[45] Date of Patent: Dec. 22, 1992

[54] PRINTER SUCH AS A COMPUTER PRINTER HAVING A SPACING ADJUSTMENT APPARATUS FOR THE PRINT HEAD

[75] Inventors: Dieter Stellmach; Martin Storz, both of Villingen, Fed. Rep. of Germany

[73] Assignee: Mannesmann Aktiengesellschaft, Düsseldorf, Fed. Rep. of Germany

[21] Appl. No.: 811,264

[22] Filed: Dec. 20, 1991

[30] Foreign Application Priority Data

Dec. 21, 1990 [DE] Fed. Rep. of Germany ..... 4041985

[51] Int. Cl.[5] ..... B41J 11/20

[52] U.S. Cl. ..... 400/56; 400/55; 400/59

[58] Field of Search ..... 400/55, 56, 57, 59, 400/60, 120, 708, 355

[56] References Cited

U.S. PATENT DOCUMENTS

| | | | |
|---|---|---|---|
| 4,010,834 | 3/1977 | Linder | 400/56 |
| 4,024,940 | 5/1977 | Hendrisch et al. | 400/56 |
| 4,090,600 | 5/1978 | Bierdermann | 400/56 |
| 4,233,895 | 11/1980 | Wehler | 400/57 |
| 4,420,269 | 12/1983 | Achermann et al. | 400/56 |
| 4,676,675 | 6/1987 | Suzuki | 400/56 |
| 4,917,512 | 4/1990 | Mimura et al. | 400/56 |

FOREIGN PATENT DOCUMENTS

| | | | |
|---|---|---|---|
| 39978 | 5/1982 | Japan | 400/57 |
| 96868 | 6/1982 | Japan | 400/57 |
| 205785 | 11/1983 | Japan | 400/59 |
| 32067 | 2/1987 | Japan | 400/59 |
| 74676 | 4/1987 | Japan | 400/59 |
| 119077 | 5/1987 | Japan | 400/56 |

*Primary Examiner*—Clifford D. Crowder
*Assistant Examiner*—J.R. Keating
*Attorney, Agent, or Firm*—Nils H. Ljungman and Associates

[57] ABSTRACT

A computer printer which has a print head and a printing bed plate comprises an apparatus to adjust the distance between the print head and the printing bed plate to thereby allow for printing on charts which are not of uniform thickness. The distance adjustment apparatus comprises a rigidly mounted sensing roller and/or a leading or trailing feeler lever, which electronically controls the print head distance.

20 Claims, 4 Drawing Sheets

PRINTER SUCH AS A COMPUTER PRINTER HAVING A SPACING ADJUSTMENT APPARATUS FOR THE PRINT HEAD

BACKGROUND OF THE INVENTION

1. Field of the Invention:

This invention relates to a printer, in particular, to a dot matrix printer for a computer, the dot matrix printer having a print head which is movable on a guide along the print line. The distance between the print head and the printing bed plate is adjustable by means of a spacing adjustment apparatus so that printing can be done on single or multiple charts which are lying on the bed plate and which may be of uneven thickness. A sensing roller is rotatably mounted on the print head to contact and roll along a chart and/or the bed plate to measure the thickness of the material being printed on.

2. Background Information:

One purpose of printers having distance adjustment devices for the print head is for the handling of different types and thicknesses of documents, e.g., savings account passbooks, or possibly even thicker documents, such as charts, or even books. Another purpose for the distance adjustment apparatus, however, is for setting the correct distance between the printing elements, which have a limited stroke, and the surface being printed upon, thereby producing the most optimum print possible. As an example, the stroke distance of typical printer pins, which stroke distance is the maximum distance a pin will move from the printing head, may be only approximately 0.3 mm to 0.5 mm. Thus, if the distance between the print head and the surface being printed upon were greater than the 0.3 mm to 0.5 mm stroke distance, no printing would occur, or if the distance was set very close to the 0.3 mm to 0.5 mm limit, the print produced would ultimately end up very light.

There are numerous examples in the prior art of printers having distance adjustment devices which operate on the basis of a spring-mounted sensing roller. One of the examples of the prior art, which is disclosed in German Publication No. DE-C1 36 41 044, is a separate rocker, or oscillating arm on which the sensing roller is mounted, and an essentially parallel rocker arm on which the print head is mounted. In this application, the two rocker arms move relative to one another under pressure applied by a spring.

An additional example of the prior art, which is disclosed in German Publication No. DE-Al 38 30 880, is a sensing apparatus in which the movement of the sensing roller, which is spring-mounted, is transmitted to a sensor and an indicator via a signal amplifier, and from there, via an analog-digital converter to a microprocessor. A stepper motor is thereby digitally controlled so that the stepper motor drives a gear wheel segment which is connected to a cam on which the print head carriage is movably mounted.

Both of these prior art solutions have at least the following two things in common, that is, first, they both have a spring-mounted sensing roller, and second, they both require that the chart being printed on be of uniform thickness over the entire print path. In each of these applications, the starting edge of the chart, among other things, need not necessarily be measured for the determination of the width of the chart as such a measurement is unnecessary.

OBJECT OF THE INVENTION

The object of the present invention is therefore to create a versatile automatic distance adjustment apparatus for a printer, which distance adjustment apparatus can be used simultaneously for printing on both relatively thin and relatively thick charts or books.

SUMMARY OF THE INVENTION

The object is achieved by a printer of the type described above and characterized by the fact that the print head and/or the print head carriage are preferably guided along a carriage which can be moved toward or away from the printing plate, land that there is a sensor which takes an analog measurement of the carriage movement. In addition, on the print head and/or on the print head carriage, there is preferably mounted, either, only a single rigid, pivoting sensing roller, or in addition to the sensing roller, preferably also a sensing lever arm. On one end of the lever arm, in contact with the printing plate or the chart being printed on, there is preferably a measurement skid, and on the other lever end, the sensor for providing the analog measurement signal may be mounted. Thus, when the print head and/or the print head carriage moves along the print line, analog measurements can be generated and transmitted to an electronic control system. In this electronic control system, the analog measurements can be stored, evaluated, and converted into digital signals. The converted digital signals can then preferably be transmitted to a servo-drive, which, operating against the force of a spring and by means of a stepper motor with a downstream intermediate transmission, positions and holds the print head carriage and/or the print head at a desired distance from the printing plate surface.

The advantage of such an arrangement, according to the present invention, is an essentially mechanically independent system. That is, with the arrangement according to the present invention in which there is a rigid sensing roller in combination with a servo-operated automatic system, one of the two systems can essentially always be in use. This is significantly different from a single spring-mounted sensing roller, as in the prior art, in which the sensing roller only functions as a result of a predetermined spring force.

The system according to the present invention therefore works either with the rigid sensing roller, or with the fully-automatic system, or both, and is therefore capable of handling papers and/or charts ranging from very thin up to significantly greater thicknesses.

The present invention also proposes that the rigid sensing roller and the feeler lever preferably be mounted so that they can pivot on a common shaft, and that the respective circumferential points at which the sensing roller and the feeler lever contact the printing surface, be at a minimum distance from one another. This minimum distance can be determined by the lever lengths of the two-armed sensing lever which functions as a rocker arm. In addition, the operation of the rigid sensing roller or the operation of the full-automatic system can be triggered as a function of the printing direction of the print head carriage, that is, from left to right or from right to left, in relation to a predetermined starting position of the print head.

In one refinement of the present invention, the shaft for the sensing roller and the feeler lever can preferably be fastened to the housing of the printer pin guide component. Thus there would be only a single axis of rotation for both the sensing roller and for the feeler lever.

In accordance with an additional feature of the present invention, the print head and the connected print head carriage can preferably be mounted so that they can move in the printing line direction along the carriage guide, which carriage guide can preferably be moved toward and away from the bed plate. In such a configuration, the rocker arm, with a lever arm, can preferably be coupled as the drive. On account of the rocker arm, it is possible to achieve the desired translation ratios for movement of the print head, and thus it is possible to achieve a response to a faster or slower adjustment to attain the correct distance.

The present invention also proposes that the drive for the rocker arm preferably consists of a servo-drive, and that the servo-drive preferably consists of a stepper motor whose motor pinion drives an intermediate transmission. At the output of the intermediate transmission there is preferably a cam, against which the lever end of the rocker arm is in contact under the force of a tension spring. According to this proposal, the print head can be moved either closer to, or farther away from the printing surface exclusively on the basis of control signals provided to the servo-drive.

In one configuration of the present invention, the rocker arm preferably comprises pairs of rocker arms mounted on a rigid axis so that they can rotate. The rocker arm tension springs are also preferably arranged in pairs, and the servo-drive and/or the intermediate transmissions are preferably equipped with shaft ends, or output shafts having a common axis. The result is an absolutely parallel adjustment of the print head in relation to the printing bed plate.

In an additional configuration of the present invention, the rocker arms are preferably mounted by means of pivot pins in the side wall of the printer and/or in the carriage guide. In this configuration, there are preferably slots in the printer side walls for receipt of the pivot pins. Thus, the carriage guide can be moved parallel to the side walls of the printer.

An additional proposal for the improvement according to the present invention is that the sensor consists of sensing elements which can be located either: between the printer side wall and the movable carriage guide; or between the rocker arm and the stationary printer side wall; or between the rear side of the carriage guide and a part of the printer fastened to the frame. Advantageously, the location point for the sensor can be where the greatest possible movement or movement translation takes place, thereby providing for the greatest amount of sensitivity to any movement which occurs.

An additional advantage of the present invention is that the measurement skid, on the side facing away from the sensing roller, can preferably have a bevelled contact surface for moving over charts of significantly different thickness. This bevelled contact surface can be advantageous with regard to relatively thick books, to thus allow the bevelled surface to pass easily over the edges of the thick books.

Another additional feature of the present invention is that the print head, the print carriage, the carriage guide with its pairs of guide rollers, and the rocker arms preferably form a single movable unit. One advantage of such a configuration is that there can essentially be no adverse effect on the other printer functions, so that relatively all printing systems can properly accommodate the distance adjustment apparatus according to the present invention.

One aspect of the invention resides broadly in a matrix printer, such as a matrix printer for a computer, the matrix printer comprising, a print head movable along a first surface, the first surface being for supporting materials to be printed upon, a carriage for moving the print head in a direction parallel to the first surface, a carriage guide for guiding the carriage parallel to the first surface, the carriage guide being movable in a direction towards and away from the first surface to thereby move the print head towards and away from the first surface, and a device for adjusting a distance between the print head and the first surface to allow for printing on a printing surface of materials of varying thicknesses. The distance adjusting device comprises a first sensing apparatus rigidly mounted to the print head, the first sensing apparatus comprising a portion for contacting the printing surface of the materials of varying thicknesses, the portion for contacting the printing surface for defining a fixed distance between the print head and the printing surface when the portion for contacting the printing surface is in contact with the printing surface, and the portion for contacting the printing surface of the materials of varying thicknesses being tensioned against the printing surface to thereby follow a contour of the printing surface to maintain the fixed distance between the print head and the printing surface.

Another aspect of the invention resides broadly in a printer comprising a print head movable along a printing surface and a distance adjusting device for adjusting a distance between the print head and the printing surface to allow for printing on a printing surface of materials of-varying thicknesses. The distance adjusting device comprises a first sensing apparatus rigidly mounted adjacent the print head, the print head being directly movable along with the first sensing apparatus as the first sensing apparatus and the print head pass over the materials of varying thicknesses, the first sensing apparatus comprising a portion for directly contacting the printing surface, the portion for directly contacting the printing surface is for defining a fixed distance between the print head and the printing surface when the portion for contacting the printing surface is in contact with the printing surface. The distance adjusting device additionally comprises a second sensing apparatus movably mounted adjacent the print head. The second sensing apparatus being spaced a distance from the first sensing apparatus, the second sensing apparatus comprising a portion for sensing the printing surface to monitor the thickness of the material being printed on. In addition, the distance adjusting device further comprises: a signal generating apparatus for generating a signal upon the sensing of a change in thickness by the second sensing apparatus; a control device for receiving the signal from the signal generating apparatus and producing an output signal for adjusting the distance from the print head to the printing surface to adjust for the varying thicknesses of the material being printed upon; and a driver for variably adjusting the distance from the print head to the printing surface based upon the output signal from the control means.

BRIEF DESCRIPTION OF THE DRAWINGS

One preferred embodiment of the invention is schematically illustrated in the accompanying drawings, in which.

DESCRIPTION OF THE PREFERRED EMBODIMENTS

Figure 1:
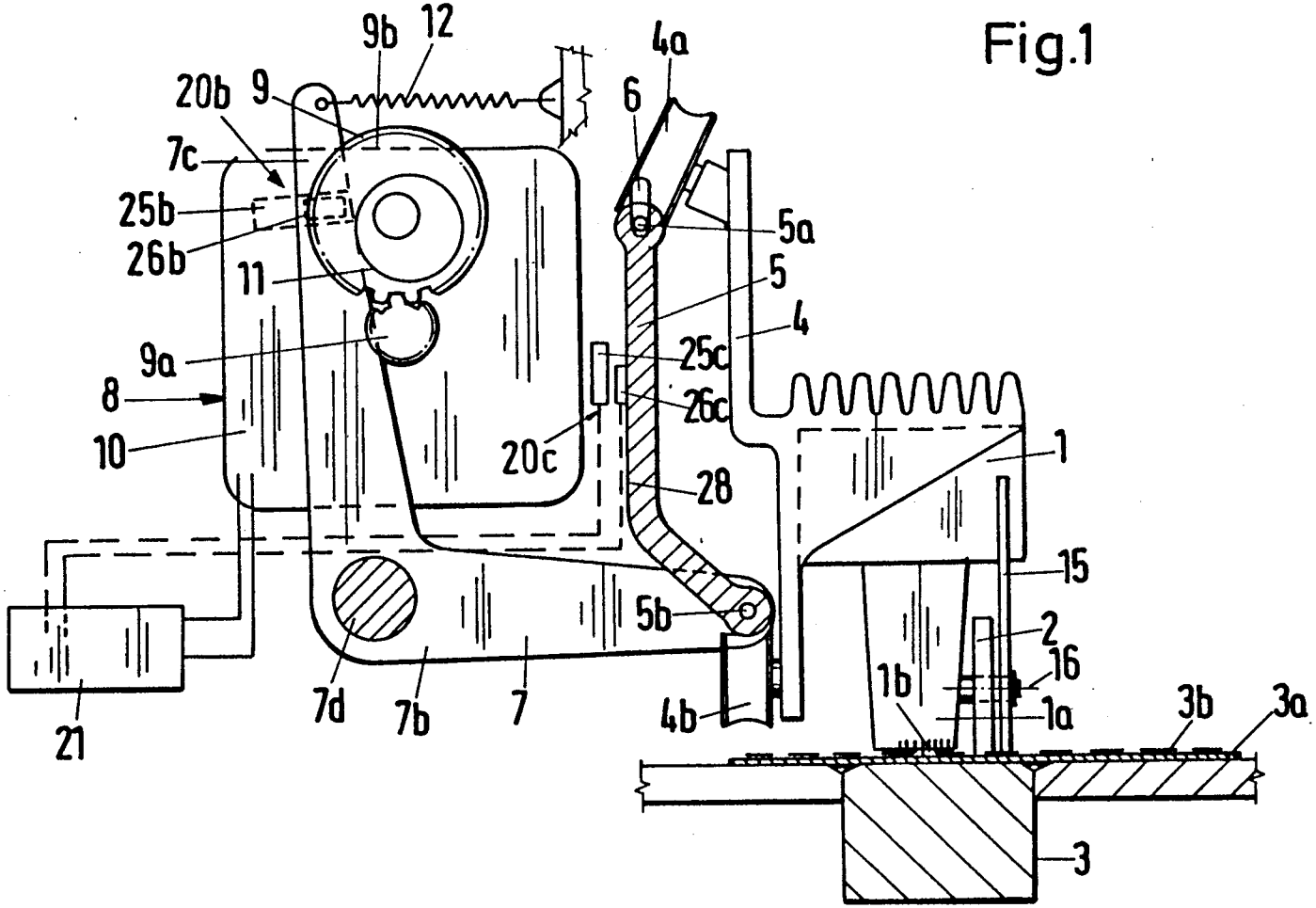
FIG. 1 shows a side view of the print head distance adjustment apparatus with a cross section taken through the bed plate.

FIG. 1 shows a printer which has a print head 1, that is preferably supported against a bed plate 3 by means of a sensing roller 2. On the bed plate 3, there may be a chart 3*a* which preferably lays flat against the bed plate without any air bubbles therebetween. The bed plate 3 can have a rectangular, square or cylindrical cross section, or any other type of cross section which provides a surface portion parallel to the path travelled by the print head. The printer pins 1*b*, which are ejected from the printer pin guidance component 1*a* of the print head 1, execute a defined limited stroke, which stroke can be in the range of from about 0.3 to 0.5 mm. Within this stroke, an ink ribbon 3*b* must be struck so that the pins 1*b* strike the ribbon against the chart 3*a* to produce dots which form a printed character.

Figure 2:
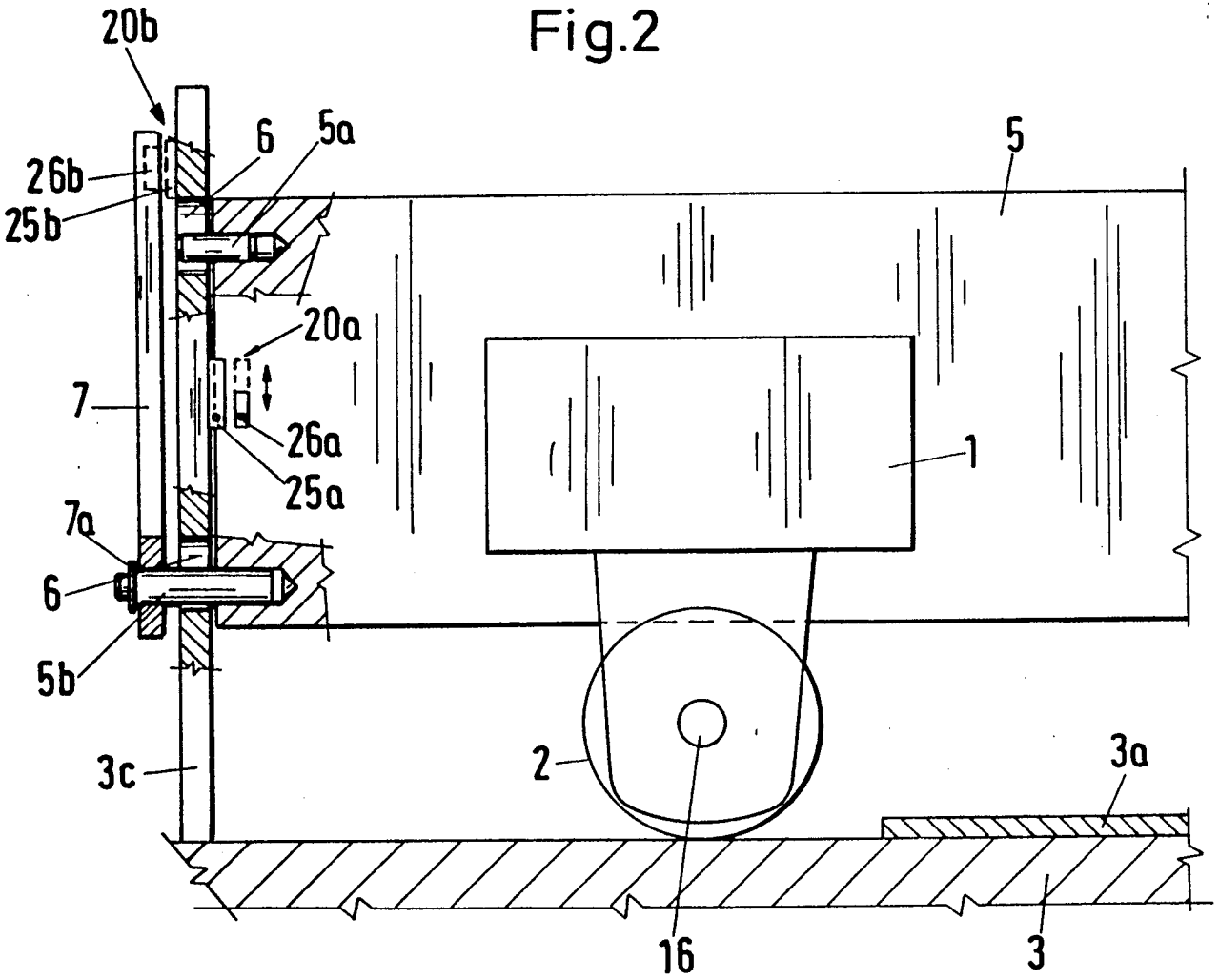
FIG. 2 shows an overhead view of the print head and the carriage guide.

The print head 1 can preferably be fastened to a print head carriage 4 which can preferably be moved perpendicularly to the plane of the drawing in FIG. 1. The print head carriage 4 preferably has two pairs of guide rollers 4*a* and 4*b*, which can be supported on a carriage guide 5. This carriage guide 5 can be made of an aluminum extrusion having bead-shaped stops for defining the movement of the guide rollers. Both ends of the carriage guide 5 can have a pair of pivot pins 5*a* and 5*b* for retaining the guide 5 within the printer unit. The upper pair of pivot pins 5*a* and the lower pair of pivot pins 5*b* can be engaged in slots 6, which are preferably located in the printer side walls 3*c*, only one of which is illustrated in FIG. 2. The lower pair of pivot pins 5*b* can preferably be engaged in rockers 7, which rockers 7 can be mounted so that they can rotate next to the printer side walls 3*c*. Each of the rockers 7 can be axially fastened to the pins 5*b* by means of an axial ring 7*a*.

Such a configuration, in which the pins 5*a* and 5*b* are disposed in the slots 6, provides mobility for the carriage guide 5 in a direction towards and away from the surface being printed on. As a result of this mobility of the pivot pins 5*a* and 5*b* in the slots 6 of the stationary printer side walls 3*c*, the carriage guide 5, together with the print head 1, can move within the plane of the drawing in FIG. 2. The total amount of movement determines the distance from the print head 1 to the chart 3*a*.

The rockers 7 preferably consist of two angled levers, each having lever arms 7*b* and 7*c*. The two angled levers can be rigidly connected to one another by means of a shaft 7*d*.

The lever arm 7*c* is preferably moved by a servo-drive 8, which preferably has an intermediate transmission 9. This intermediate transmission 9 essentially consists of the motorized pinion 9*a* of the stepper motor 10, which motorized pinion 9*a* can be engaged in a larger gear wheel 9*b*. Mounted on the gear wheel 9*b* is preferably a cam disc 11, against which the lever arm 7*c* can be constantly held under the force of a tension spring 12, as shown in FIG. 1. The force of the tension spring 12 can simultaneously determine the application pressure of the print head 1 against the bed plate 3, provided that this force is not eliminated by an opposing force.

Figure 3:
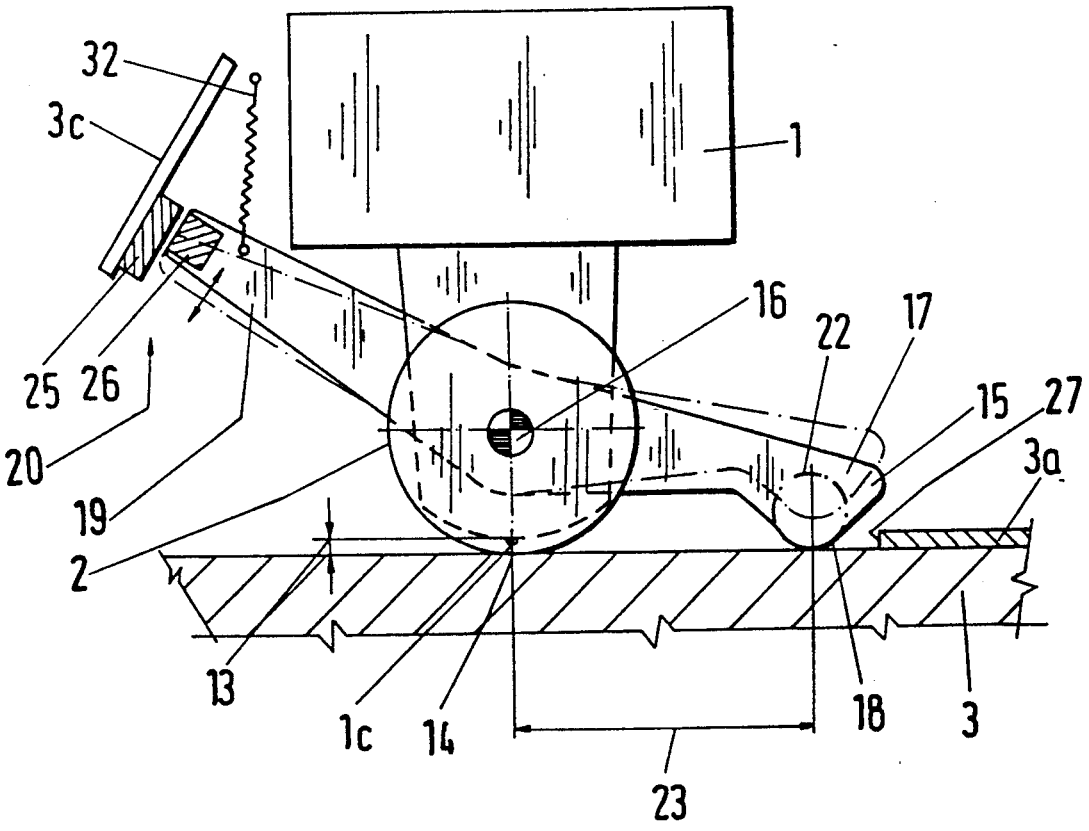
FIG. 3 shows an overhead view of the print head with sensing roller and feeler lever.

The print head 1 can essentially be held by the sensing roller 2 at a set distance from the bed plate 3 or the chart 3*a*. This distance should preferably correspond to a distance 13 between the outermost circumferential point 14 of the roller 2 and the print element 1*c*, as shown in FIG. 3. This distance is often considered the "print distance".

On the printer pin guidance component 1*a* there can also be a feeler lever 15 for sensing the thickness of the chart 3*a*. The feeler lever 15 is preferably mounted so that it can rotate about a given axis. It is possible to arrange the feeler lever 15 so that it can be rotated on the same axis 16 as the sensor roller 2, which axis is preferably located on the printer pin guidance component 1*a*. On the lever end 17 of the feeler lever 15 there is preferably a measurement skid 18, and on the other lever end 19, there is preferably a sensor arrangement 20, as shown in FIG. 3.

The sensor arrangement 20 can be used to generate an analog measurement signal, so that when the print head 1 or the print head carriage 4 moves along a print line along the chart 3*a*, analog measurements are taken. These analog measurement can then preferably be transmitted to an electronic control system 21.

The measurement values can preferably be stored and evaluated in the electronic control system 21, which control system 21 can also preferably convert the analog measurements into digital signals. In digital form, the signals can be input into the servo-drive 8, whose stepper motor 10, by means of the downstream intermediate transmission 9, is able to move the print head carriage 4 and/or the print head 1 to a new position. This movement is thus, essentially carried out independently of the sensing roller 2. This new distance from the print head to the printing surface can thus always be greater than the distance difference 13 of the print elements 1*c* to the peripheral point 14 on the roller 2.

The measurement skid 18 could, of course, also have a roller 22 to reduce friction as the skid 18 moves across the printing surface, see FIG. 3. This roller can be of any suitable diameter that would allow easy passage of the roller over edges of the material being printed upon. The measurement skid 18 should also preferably be located at some minimum distance 23 from the sensing roller 2 or from the print elements 1*c*.

A tension spring 32 can be fastened on the lever end 19 to apply tension to the feeler lever 15 so that the lever end 17 is held against the chart 3*a* or the bed plate 3. On the outermost region of the lever end 19, there can be a sensor arrangement 20, preferably formed of elements 25 and 26 which can be moved relative to one another. This sensor arrangement can then be used to generate a signal upon relative movement between the two elements 25 and 26. Thus, upon passage of the lever end 17 over the edge of a chart, for example, the sensor element 26 would be displaced relative to the sensor element 25, which element 25 should preferably be rigidly attached to the carriage 1 to move along with the carriage as the carriage moves along the printing path. This displacement would then preferably produce an analog signal that could be processed in the electronic control system 21 to provide a measurement of the thickness of the material that either is, or will be printed upon. These sensor elements 25 and 26 may be optical, magneto-resistive, or inductive sensors.

In addition, there may be other pairs of sensor elements: 25*a*, 26*a*; 25*b*, 26*b*; and/or 25*c*, 26*c*, for providing additional or alternative sensor arrangements 20*a*, 20*b*, and 20*c*. The sensor elements 25*a* and 26*a*, as shown in FIG. 2, could be located between the printer side wall 3*c* and the carriage guide 5. In addition, the sensor arrangement could possibly comprise elements 25*b* and 26*b* positioned between the rocker 7 and the printer side wall 3*c*, as shown in both FIGS. 1 and 2. Another possibility is that the sensor arrangement can consist of the sensor elements 25*c* and 26*c* between the back wall 28 of the carriage guide 5 and a portion of the printer fastened to the frame, which arrangement is shown in FIG. 1. These alternative arrangements 20*a*, 20*b*, and 20*c*, of sensor elements would preferably produce an analog signal upon the direct displacement of the carriage guide with respect to the fixed printer walls.

The sensor analog signals can be amplified and converted to digital signals in the electronic control system 21. The digital signal can then be processed by the microprocessor, and the microprocessor then outputs a signal to control a driver circuit of the servo-drive 8.

Figure 4:
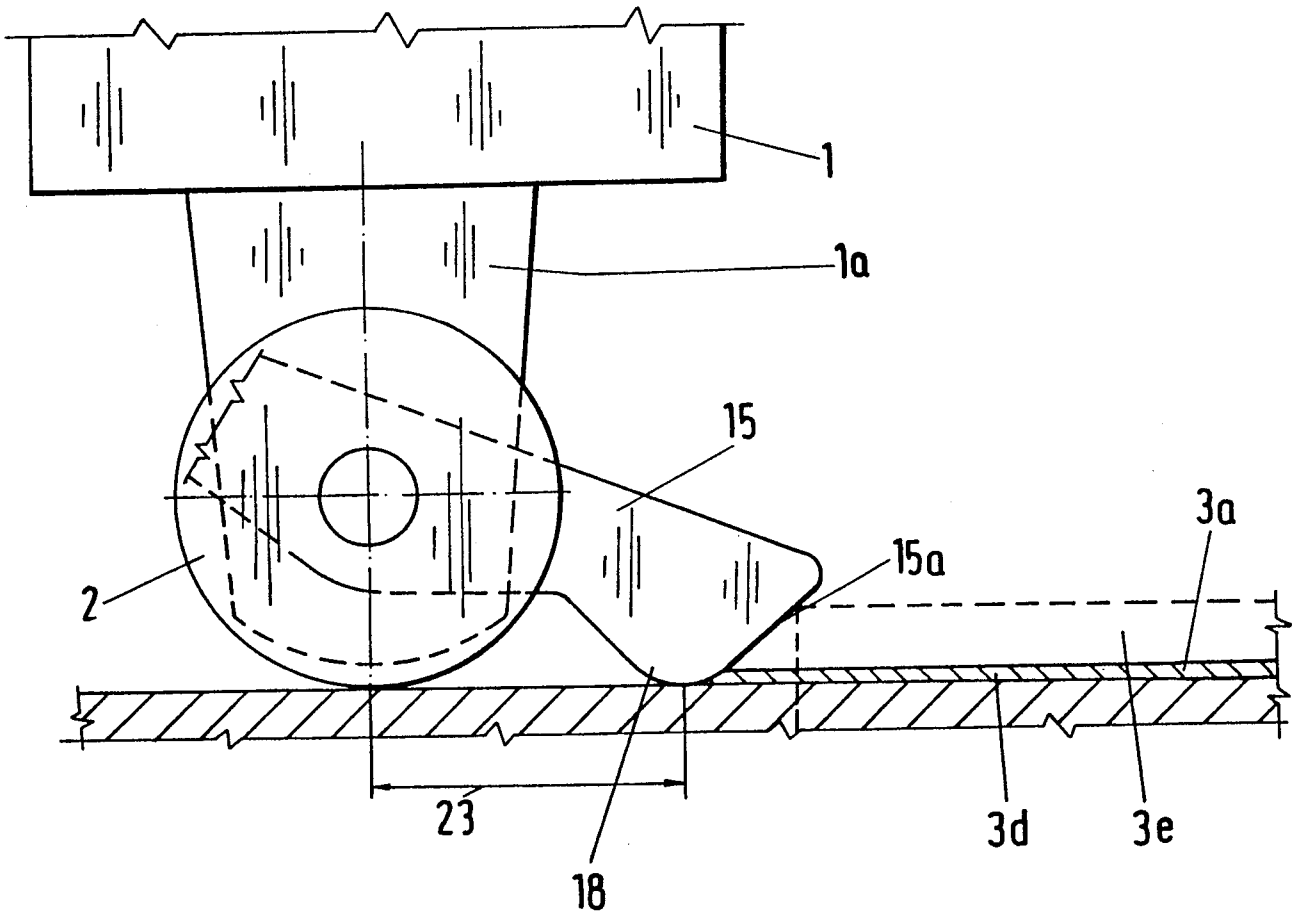
FIG. 4 shows a detail of the feeler lever and measurement skid on an enlarged scale.

The printer with the print head distance adjustment apparatus as described above can work essentially as follows, however other operating schemes not beyond the scope of this application are also possible: The print head 1, as shown in FIG. 2, begins outside the path of the chart 3*a*. The chart 3*a*, to be printed on, is pulled into the printer and is set at the first printed line. The print head 1 then moves toward the right (FIGS. 2 and 3). When the feeler lever 15 reaches the edge 27 of the chart 3*a* and a jump function is triggered. The thickness 3*d* or 3*e* of the chart is then measured (FIG. 4). The position of the chart 3*a* is calculated by means of the position of the print head carriage 4 and a correction factor which is a function of the thickness (FIG. 4). The servo-drive 8 then sets the print head distance 13, generally before the print elements 1*c* have reached the portion of the chart to be printed on.

It is advantageous that the measurement point of the feeler lever 15 precedes the print point of the print head 1 by a minimum distance 23 so that the servo-drive 8 has sufficient time to make the necessary distance adjustment. To index, the print head can either travel beyond the edge 27, or the servo-drive 8 can raise the print head 1 by an amount which is necessary to be able to safely execute the indexing of the chart 3*a*.

An alternative operating sequence can be used to print books. In this sequences, the distance between the print head and the printing surface is set by the sensor roller 2 on the print head 1. During printing, therefore, the servo-drive 8 can essentially remain in the base position. In this manner, the tension of spring 12 will hold the sensing roller 2 against the pages, applying a pressure to the pages to hold them flat while the print head prints on the pages. To index while printing a book (e.g. a savings passbook), the servo-drive 8 can raise the print head 1 from the book, or the print head 1 can be moved alongside the book.

In addition, when printing a book, it is also possible to reduce the impacts which would occur when the print head passes over the edge (i.e. edge 27) of the book or a book seam. If only a single sensing roller were used, the print head would follow the sensing roller as it passed into the seam or over the book edge, thereby jolting the print head. However, with the arrangement according to the present invention, this can be avoided by means of the servo-drive 8, which servo-drive 8 can maintain or raise the print head distance when an edge or a seam is being passed over. For this purpose, the servo-drive 8 can set a slightly smaller printing distance 13 than the value measured by the sensor arrangement 20, so that the sensing roller 2 could determine the distance between the print head and the printing surface when printing was occurring. When the edge of the book, or the seam was passed over, the servo-drive 8 would then come into action to allow the printing distance to change only by the slightly smaller amount as determined by the sensor arrangement. In this manner, the book pages would nevertheless be pressed together when the print head passed over them.

In summary, one aspect of the invention resides broadly in a printer, in particular a dot-matrix printer, with a print head which can move on a guide along the print line, and with an apparatus to adjust the distance between the print head and a bed plate for unevenly thick, single or multiple charts lying on the bed plate, whereby a sensing roller mounted so that it can rotate on the print head is in contact with the chart and/or with the bed plate, characterized by the fact that on the print head 1 or on the print head carriage 4, there is either a rotating, rigidly mounted sensing roller 2 with a carriage guide 5 which can be moved toward and away from the bed plate 3, and a sensor arrangement 20 which performs an analog measurement of the carriage movement, or that in addition to the sensing roller 2 there is a feeler lever 15, on whose end in contact with the bed plate 3 and/or the chart 3*a* there is a measurement skid 18, and on its other lever end 19, there is a sensor arrangement 20 for an analog measurement signal, so that when the print head 1 or the print head carriage 4 moves along the printer line, analog measurement values can be generated and transmitted to an electronic control system 21, in which the measurements can be stored and evaluated, and that the signals converted into digital signals can be transmitted to a servo-drive 8 which holds the print head carriage 4 or the print head 1 at a desired distance from the bed plate 3 against the force of a spring 12 by means of a stepper motor 10 with a downstream intermediate transmission 9.

Another aspect of the invention resides broadly in a printer characterized by the fact that the sensing roller 2 and the feeler lever 15 are mounted so that they can rotate on a common shaft 16 and that the contacting circumferential points 14 are at a minimum distance 23 from one another, which can be defined by the lever lengths of the two-arm feeler lever 15 designed as a rocker 7.

A further aspect of the invention resides broadly in a printer characterized by the fact that the shaft 16 for the sensing roller 2 and the feeler lever 15 is fastened to the housing of the printer pin guide component 1*a*.

A yet further aspect of the invention resides broadly in a printer characterized by the fact that the print head 1 and the connected print head carriage 4 is mounted so that it can move in the direction of the line on the carriage guide 5 which can be moved toward and away from the bed plate 3, whereby as a drive mechanism, the rocker arm 7 is coupled to a lever arm 7*b*.

An additionally aspect of the invention resides broadly in a printer characterized by the fact that the drive for the rocker arm 7 consists of the servo-drive 8 and that the latter consists of a stepper motor 10, whose motorized pinion 9*a* drives an intermediate transmission 9, whereby at the output of the intermediate transmission 9 there is a cam disc 11, against which the lever end 7*c* of the rocker 7 is in contact under the force of a tension spring 12.

Another additional aspect of the invention resides broadly in a printer characterized by the fact that the rockers 7 are mounted in pairs so that they can rotate on a rigid axis 7*d*, that there are also pairs of tension springs 12, and that the servo-drive 8 or the intermediate transmission 9 has motor shaft ends and/or output shafts having the same axis.

Another additional aspect of the invention resides broadly in a printer characterized by the fact that the rocker 7 is mounted by means of a pivot 5*b* in the printer side wall 3*c* or in the carriage guide 5, and that in the printer side wall 3*c* there is a slot 6 for the pivots 5*a* and 5*b*.

Another additional aspect of the invention resides broadly in a printer characterized by the fact that the sensor arrangement can consist of at least one set of elements 25*a*, 26*a*; 25*b*, 26*b*; 25*c*, 26*c*; which are located either between the printer side wall 3*c* and the movable carriage guide 5 or between the rocker 7 and the stationary printer side wall 3*c*, or between the rear side 28 of the carriage guide 5 and a part of the printer fastened to the frame.

Another additional aspect of the invention resides broadly in a printer characterized by the fact that the measurement skid 18, on the side facing away from the sensing roller 2, has a bevelled contact surface 15*a*, for charts 3*a* of significantly differing thicknesses.

Another additional aspect of the invention resides broadly in a printer characterized by the fact that the print head 1, the print carriage 4 and the carriage guide 5, form a movable unit with pairs of guide rollers 4*a*, 4*b* and the rocker 7.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A matrix printer, such as a matrix printer for a computer, said matrix printer comprising:

first surface means for supporting materials to be printed upon;

a print head movable along the first surface carriage means for moving the print head in a direction parallel to the first surface;

carriage guide means for guiding the carriage means parallel to the first surface, said carriage guide means being movable in a direction towards and away from the first surface to thereby move the print head towards and away from the first surface;

means for adjusting a distance between the print head and the first surface to allow for printing on a printing surface of materials of varying thicknesses, the materials of varying thicknesses having a first dimension for being disposed in a direction parallel to said first surface, said distance adjusting means comprising:

first sensing means rigidly mounted to the print head, said first sensing means being movable along with the print head in the direction parallel to the first surface to sense the thickness of the material being printed upon along at least said first dimension;

said first sensing means comprising a portion for contacting the printing surface of the materials of varying thicknesses, said contacting portion of said first sensing means extending a fixed distance away from the print head towards the printing surface to define a fixed distance between the print head and the printing surface when said contacting portion of said first sensing means is in contact with the printing surface;

means for tensioning the print head towards the printing surface of the materials of varying thicknesses to thereby follow a contour of the printing surface and maintain said fixed distance between the print head and the printing surface when said contacting portion of said first sensing means is in contact with the printing surface;

second sensing means mounted adjacent the print head, said second sensing means being movable along with the print head in the direction parallel to the first surface to sense the thickness of the material being printed upon along at least said first dimension;

said second sensing means comprising:

a portion for sensing the thickness of the material being printed on;

signal generating means for generating a signal corresponding to the thickness of the material sensed by said second sensing means along at least said first dimension;

control means for receiving said signal from said signal generating means and producing an output signal for variably adjusting the distance from the print head to the printing surface along at least said first dimension; and drive means for adjusting the distance from the print head to the printing surface to a distance of at least the fixed distance based upon said output signal from said control means.

2. The matrix printer according to claim 1, wherein:

said first sensing means comprises roller means;

said print head comprises a shaft disposed thereon, said shaft having a shaft axis;

said roller means is rotatably mounted on said shaft to rotate about the shaft axis;

said roller has an outer peripheral edge;

said contacting portion comprises the outer peripheral edge of said roller means; and said roller means being for rolling over the contour of the printing surface to sense the thickness of the materials being printed upon and to maintain the fixed distance between the print head and the printing surface when said roller means is contacting the printing surface.

3. The matrix printer according to claim 2, wherein:

said carriage guide means comprises a first longitudinal edge disposed parallel to the first surface, and a second longitudinal edge disposed parallel to the first surface and spaced apart from said first longitudinal edge;

said carriage means comprises a first pair of guide roller means for rolling along and being guided by said first longitudinal edge, and a second pair of guide roller means for rolling along and being guided by said second longitudinal edge, each guide roller means in both said first and said second pairs of guide roller means being spaced apart from the other guide roller means of the pair of guide roller means to provide said parallel guidance of said carriage means along said carriage guide means; and said carriage guide means, said carriage means, and said print head comprise an integral movable unit movable in the direction toward and away from the first surface.

4. The matrix printer according to claim 3, wherein:

said carriage guide means has a first end and a second end, each of said first end and said second end comprising at least two pin guides disposed spaced apart from one another along of said first end and said second end; and the matrix printer comprises a housing having side walls, the side walls having slot means therein for receipt of the pin guides of the ends of said carriage guide means to movably mount said carriage guide means within said printer housing for movement of said carriage guide means in the direction toward and away from the first surface.

5. The matrix printer according to claim 4, wherein:

said second sensing means is movably mounted on the print head, said second sensing means being spaced a distance from said first sensing means.

6. The matrix printer according to claim 5, wherein:

said second sensor means comprises a feeler lever;

said feeler lever being mounted on said shaft on said print head;

said feeler lever having a first end means for contacting the printing surface, a second end means disposed opposite said first end means, and a pivot point therebetween, said pivot point comprising said shaft axis;

said second sensor means comprises means for tensioning said first end means against the printing surface; and said first end means of said feeler lever comprises means for allowing said first end means to pass over the varying thicknesses of materials to be printed upon, said means for allowing comprising at least one of: a bevelled surface and a roller.

7. The matrix printer according to claim 6, wherein said drive means comprises:

a motor for receiving said output signal from said control means, said motor having a rotatable motor shaft;

lever arm means having a first end connected to one of said guide pins of said carriage guide means, and a second end disposed substantially opposite said first end, and a pivot point therebetween;

said lever arm means being pivotable about the pivot point disposed between said first end and said second end;

transmission means disposed between said rotatable motor shaft and said second end of said lever arm means for receiving rotary motion of said rotatable motor shaft to produce movement of said carriage guide means in the direction towards or away from the first surface; and said transmission means comprising cam means against which said second end of said lever arm means is tensioned.

8. The matrix printer according to claim 7, wherein:

said signal generating means comprises at least one first element and at least one second element;

said at least one first element being mounted to one of:

said carriage guide means;

said lever arm means; and said feeler lever;

to be movable along with the one of: said carriage guide means, said lever arm means, and said feeler lever to which said at least one first element is mounted;

said at least one second element being mounted in a fixed position with respect to said at least one first element, whereby said at least one first element is movable past said at least one second element to generate analog signal means corresponding to the thickness of the material being printed upon.

9. The matrix printer according to claim 8, wherein:

said at least one first element and said at least one second element of said signal generating means are mounted at at least one of the following locations:

said movable element on the second end of said feeler lever means and said fixed element on said carriage means;

said movable element on one of said first and said second ends of said carriage guide means and said fixed element on the housing;

said movable element on said lever arm means and said fixed element on the printer housing; and said movable element on a surface of said carriage guide means and said fixed element on a part of the printer fastened to the printer housing.

10. The matrix printer according to claim 9, wherein:

the at least one first element and the at least one second element of said signal generating means comprise at least one of:

optical sensors;

magneto-resistive sensors; and inductive sensors;

said control means comprises:

means for receiving said analog signals from said at least one first element and said at least one second element;

means for storing said analog signals;

means for evaluating said analog signals;

means for converting said analog signals to digital signals; and means for outputting said digital signals to said motor means;

said motor means comprises a stepper motor;

said drive means comprises two lever arm means, each of said two lever arm means having a first end connected to one of said guide pins of said carriage guide means on opposite ends of said carriage guide means, and a second end disposed substantially opposite said first end, and having a pivot point therebetween, said pivot point of each of said two lever arm means comprise a common pivot point;

said drive means comprises transmission means for transmitting power from said motor means to each of said two lever arm means, and each of said two lever arm means being movable by said transmission means driven by said motor means;

said print head comprises a plurality of printing pin means for being ejected away from the print head toward said printing surface, said printer comprises a printing ribbon for being disposed between said printing pin means and said material to be printed upon, and said printing pin means being for striking the printing ribbon against the printing surface to produce printed dots;

said printing pins being ejectable from said print head a distance of from between about 0.3 mm to about 0.5 mm;

said carriage guide comprises extruded aluminum and said first and said second longitudinal edges of said carriage guide comprise aluminum beads along which the guide rollers are guided;

said control means comprises a microprocessor for processing said signal from said signal generating means; and said second sensing means and said first sensing means are operable independently of one another.

11. A printer comprising a print head movable along a printing surface and a distance adjusting means for adjusting a distance between the print head and the printing surface to allow for printing on a printing surface of materials of varying thicknesses, said distance adjusting means comprising:

first sensing means rigidly mounted adjacent the print head, the print head being directly movable along with said first sensing means as said first sensing means and said print head pass over the materials of varying thicknesses;

said first sensing means comprising a portion for directly contacting the printing surface, said contacting portion of said first sensing means extending a distance away from the print head towards the printing surface to define a fixed distance between the print head and the printing surface when said contacting portion is in contact with the printing surface;

second sensing means movably mounted adjacent the print head, said second sensing means being movable along with the print head as said print head passes over the materials of varying thicknesses, said second sensing means being spaced a distance from said first sensing means;

said second sensing means comprising a portion for sensing the printing surface to monitor the thickness of the material being printed on;

signal generating means for generating a signal upon the sensing of a change in thickness by said second sensing means;

control means for receiving said signal from said signal generating means and producing an output signal for variably adjusting the distance from the print head to the printing surface to adjust for the varying thicknesses of the material being printed upon; and drive means for variably adjusting the distance from the print head to the printing surface based upon said output signal from said control means.

12. The printer according to claim 11, wherein:

said print head comprises a shaft thereon, said shaft having a shaft axis;

said first sensing means comprises a sensing roller means, said sensing roller means having an outer peripheral edge, and said sensing roller means for being disposed on said shaft and rotatable about the shaft axis;

said contacting portion comprises the outer peripheral edge of said roller;

said roller means being for rolling over the contour of the printing surface to sense the thickness of the materials being printed upon to maintain a fixed distance between the print head and the printing surface when said roller means is contacting the printing surface;

said second sensing means comprises a feeler lever;

said feeler lever having a first end means for contacting the printing surface, a second end disposed opposite said first end, and a pivot point therebetween;

said second sensor means comprising means for tensioning said first end means against the printing surface; and said first end means of said feeler lever comprises means for allowing said first end means to pass over varying thicknesses of materials to be printed upon, said means for allowing comprising at least one of: a bevelled surface and a roller.

13. The printer according to claim 12, further including:

carriage means for moving the print head in a direction parallel to the first surface, said print head being connected to said carriage means;

carriage guide means for guiding the carriage means parallel to the first surface, said carriage means being movable along said carriage guide means in a direction parallel to the printing surface, said carriage guide means being movable in a direction towards and away from the first surface to thereby move the print head in a direction towards and away from the first surface.

14. The printer according to claim 13, wherein:

said signal generating means comprises at least one first element and at least one second element;

said at least one first element being mounted to be moved upon a change in thickness of the material being printed upon;

said at least one second element being mounted in a fixed position with respect to said at least one first element, whereby said at least one first element is movable past said at least one second element to generate analog signal means corresponding to the thickness of the material being printed upon.

15. The printer according to claim 14, wherein:

said carriage guide means has a first end and a second end, each of said first end and said second end being perpendicular to the printing surface, and each of said first end and said second end comprising at least two pin guides disposed spaced apart from one another along each of said first end and said second end;

the printer comprises a housing having side walls disposed parallel to said first and said second end of said carriage guide means, the side walls having slot means therein for receipt of the pin guides of the ends of said carriage guide means to movably mount said carriage guide means within said printer housing for movement of the carriage guide means in the direction toward and away from the printing surface.

16. The printer according to claim 15, wherein:

said carriage guide means comprises a first longitudinal edge disposed parallel to the printing surface, and a second longitudinal edge disposed parallel to the first surface and spaced apart from said first longitudinal edge;

said carriage means comprises a first pair of guide roller means for rolling along and being guided by said first longitudinal edge, and a second pair of guide roller means for rolling along and being guided by said second longitudinal edge, each guide roller means in both said first and said second pairs of guide roller means being spaced apart from the other guide roller means of the pair of rollers to provide said parallel guidance of said carriage means along said carriage guide means; and said carriage guide means, said carriage means, and said print head comprise an integral movable unit, movable in the direction toward and away from the first surface.

17. The printer according to claim 16, wherein said drive means comprises:

a motor for receiving said output signal from said control means, said motor having a rotatable motor shaft;

lever arm means having a first end connected to one of said guide pins of said carriage guide means, a second end disposed substantially opposite said first end, and a pivot point therebetween;

said lever arm means being pivotable about the pivot point disposed between said first end and said second end;

transmission means disposed between said rotatable motor shaft and said second end of said lever arm means for receiving rotary motion of said rotatable motor shaft to produce movement of said carriage guide means in the direction towards or away from the first surface; and said transmission means comprising cam means against which said second end of said lever arm means is tensioned.

18. The printer according to claim 17, wherein:

said drive means comprises two lever arm means, each of said two lever arm means having a first end connected to one of said guide pins of said carriage guide means on opposite ends of said carriage guide means, a second end disposed substantially opposite said first end, and a pivot point therebetween;

said pivot point of each of said two lever arm means comprising a common pivot point disposed between said first end and said second end of each of said two lever arm means;

said drive means comprises transmission means for transmitting power from said motor means to each of said two lever arm means; and each of said two lever arm means being movable by said transmission means driven by said motor means.

19. The matrix printer according to claim 18, wherein:

said at least one first element and said at least one second element of said signal generating means are mounted at at least one of the following locations:

said movable element on the second end of said feeler lever means and said fixed element on said carriage means;

said movable element on one of said first and said second ends of said carriage guide means and said fixed element on the housing;

said movable element on one of said two lever arm means and said fixed element on the printer housing; and said movable element on a surface of said carriage guide means and said fixed element on a part of the printer fastened to the printer housing.

20. The printer according to claim 19, wherein:

the at least one first element and the at least one second element of said signal generating means comprise at least one of:

optical sensors;

magneto-resistive sensors; and inductive sensors;

said control means comprises:

means for receiving said analog signals from said at least one first element and said at least one second element of said signal generating means;

means for storing said analog signals;

means for evaluating said analog signals;

means for converting said analog signals to digital signals; and means for outputting said digital signals to said motor means;

said motor means comprises a stepper motor;

said sensing roller means and said feeler lever rotate about a common axis;

said common axis is disposed on said print head;

said print head comprises a plurality of printing pin means for being ejected away from the print head toward said printing surface, said printer comprising a printing ribbon for being disposed between said printing pin means and said material to be printed upon, and said printing pins being for striking the printing ribbon against the printing surface to produce printed dots;

said printing pins being ejectable from said print head a distance of from between about 0.3 mm to about 0.5 mm;

said carriage guide comprises extruded aluminum and said first and said second longitudinal edges of said carriage guide comprise aluminum beads along which the guide rollers are guided;

said control means comprises a microprocessor for processing said signal from said signal generating means; and said second sensing means and said first sensing means are operable independently of one another.

* * * * *